US007357676B2

(12) United States Patent
Ecker et al.

(10) Patent No.: US 7,357,676 B2
(45) Date of Patent: Apr. 15, 2008

(54) FUSE HOLDER FOR FLAT FUSES

(75) Inventors: Stefan Ecker, Vilsbiburg (DE); Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 11/268,717

(22) Filed: Nov. 7, 2005

(65) Prior Publication Data

US 2006/0128224 A1 Jun. 15, 2006

(30) Foreign Application Priority Data

Nov. 5, 2004 (DE) ..... 10 2004 053 578

(51) Int. Cl.
*H01R 13/68* (2006.01)

(52) U.S. Cl. ..... 439/620.27

(58) Field of Classification Search ..... 439/620.27, 439/76.2

See application file for complete search history.

(56) References Cited

U.S. PATENT DOCUMENTS

| | | | | |
|---|---|---|---|---|
| 3,955,877 | A | 5/1976 | Cobaugh et al. | |
| 4,775,336 | A | 10/1988 | Paulo | |
| 5,060,372 | A | 10/1991 | Capp et al. | |
| 5,417,589 | A | 5/1995 | Terada | |
| 6,089,918 | A * | 7/2000 | Arakelian et al. | 439/620.27 |
| 6,231,406 | B1 | 5/2001 | Lin et al. | |
| 6,443,771 | B2 * | 9/2002 | Kondo et al. | 439/620.27 |
| 6,755,677 | B2 | 6/2004 | Kamiya | |
| 6,764,357 | B2 | 7/2004 | Wu et al. | |
| 7,241,191 | B2 | 7/2007 | Ecker et al. | |
| 2003/0022529 | A1 | 1/2003 | Phillips et al. | |
| 2004/0067698 | A1 | 4/2004 | Lee | |

* cited by examiner

*Primary Examiner*—Javaid H. Nasri
(74) *Attorney, Agent, or Firm*—Wolf, Greenfield & Sacks, P.C.

(57) ABSTRACT

A fuse holder for use in motor vehicles. The fuse holder comprises an elongated box-shaped housing having flat-fuse type slots accessible from the upper side of the housing and contact chambers arranged beneath the slots within the housing. The chambers can receive the contact feet of single contacts and/or current bridges. Contact chambers of the current bridge and of the single contacts can be substantially identically configured, which may permit a more versatile use. Each contact chamber can be fitted with two mutually facing catch recesses for catch projections of the single contacts. Each contact chamber can also be fitted with at least one catch recess for the current bridge. Moreover, each contact chamber can be fitted with a receiving shaft for two contact feet where the feet are aligned parallel to one another and transverse to the extension direction of the elongated housing.

19 Claims, 2 Drawing Sheets

FUSE HOLDER FOR FLAT FUSES

BACKGROUND OF INVENTION

1. Field of Invention

Aspects of the invention relate to fuse holders, in particular to fuse holders for use in motor vehicles.

2. Discussion of Related Art

Fuse holders are used in low-voltage applications in the automotive industry. The dimensions of elongated fuse holder housings can be "standardized" to enable a number of fuse holders corresponding to the number of required slots to be combined and arranged side by side and in series within a fuse box.

Standards for elongated housings have been developed by various automotive manufacturers to permit a modular set-up for fuse holders. In such a modular structure, a plurality of fuse holders can be combined into a block to save space.

Standards often specify the width and various other dimensions of fuse holders, except that the fuse holders may be of varying length. In this manner, fuse holders that accommodate different numbers of flat fuses (for instance 4-pole fuse holders or strips and 12-pole fuse holders or strips) can be combined together.

Fuse holders may be used for Form C type flat fuses (DIN 72581-3). Housing dimensions can be adapted for flat fuses arranged in series, transverse to the longitudinal axis, within slots, enabling a large number of Form C flat fuses to be accommodated in a manner that takes up little space.

Such fuse holders may also be suitable for Form F type flat fuses. In terms of their width, height and length, Form F fuses are somewhat smaller than the Form C counterparts. As with the Form C flat fuses, the dimensions of Form F flat fuses may make it possible for them to be likewise arranged within the corresponding slots transverse to the longitudinal axis of the fuse holder.

The fuse holder may be formed with contact chambers to accommodate the contact sections of a current bridge and of single contacts. Fuse holder of the prior art are often designed for specific configurations of current bridges and single contacts. For example, contact chambers for the current bridge may have different dimensions from those of the contact chambers for single contacts. This can be due to the fuse-holder dimensions specified by standards, like those described herein. This can also be due to the contact feet of the current bridge and/or the single contacts consisting of a spring leg and a cooperating abutment leg offset thereto by 90°. Constructing fuse holders on a specific configuration can, however, lead to a limited range of applications.

SUMMARY

According to one aspect of the invention, a fuse holder for use in motor vehicles is disclosed. The fuse holder comprises an elongated box-shaped housing having flat-fuse type slots accessible from an upper side of the housing and having contact chambers arranged below the slots within the housing. The slots are adapted to receive contact feet of single contacts and/or current bridges. The contact chambers for the current bridge and for the single contacts are substantially identical. Each contact chamber is provided with two mutually facing catch recesses for catch projections of the single contacts, and is also provided with at least one catch recess for the current bridge. Each contact chamber comprises a receiving shaft adapted to receive two contact feet, where the feet are aligned parallel to one another and transverse to an extension direction of the elongated housing.

According to another aspect of the invention, a fuse holder for use in motor vehicles is disclosed. The fuse holder comprises an elongated box-shaped housing defining a longitudinal axis and having a first side and an opposed second side. The housing includes a plurality of flat-fuse slots disposed in the first side and extending along the longitudinal axis of the housing. A plurality of similar contact chambers are disposed in the second side and extend along the longitudinal axis. Each of the contact chambers is substantially identical and are adapted to receive either the contact feet of a single contact or the contact feet of a current bridge.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
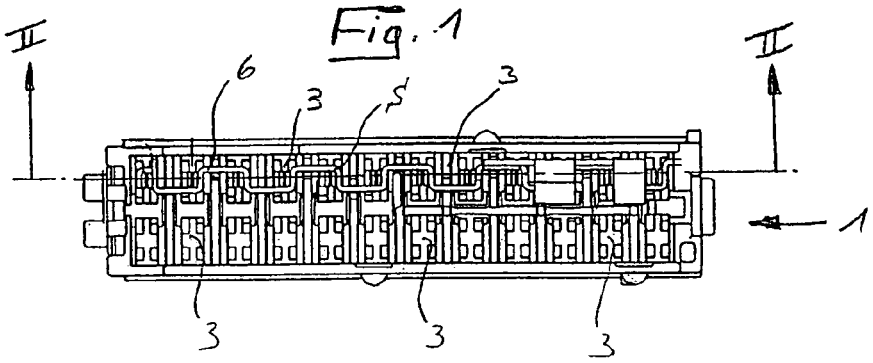
FIG. 1 is a top view of a fuse holder according to one embodiment of the invention.

Embodiments of the present invention include a fuse holder that permits more versatile use. In one embodiment, a more versatile fuse holder has similar contact chambers that can receive either a current bridge or single contacts. Each contact chamber may be provided with two mutually facing catch recesses for catch projections of the single contacts. Each chamber may also be provided with at least one catch recess for the current bridge. Other suitable arrangements for capturing components inserted into the chamber may be employed, as the present invention is not limited in this respect. Each contact chamber may comprise a receiving shaft for two contact feet respectively, the feet being aligned parallel to one another and transverse to the extension direction of the elongated housing.

The fuse holder may comprise an elongated box-shaped housing, having flat-fuse type slots accessible from an upper side of the housing. Contact chambers adapted to receive contact feet of single contacts and/or current bridges may be arranged beneath the slots within the housing.

Embodiments of the fuse holder can be used for universal purposes. For example, it is possible to equip a box-shaped housing with current bridges and single contacts in a very wide variety of ways. Each chamber can receive either contact feet of a current bridge or contact feet of single contacts. As a result, many possible variations may be obtained. Moreover, a box-shaped housing can be fitted with current bridges of varying length. As a result, the range of applications for fuse holders designed in accordance with aspects of the present invention can be very broad. Embodiments of the holder create an all-purpose housing that results in an unprecedented number of possible variations. This can permit a reduction in the number of housing versions, which may result in decreased manufacturing costs.

As discussed herein, the dimensions specified by a standard may limit the design for such box-shaped housings to narrow restrictions. However, space may still be saved by using current bridges with two contact feet aligned parallel to one another instead of contact feet aligned perpendicular to one another as found in some spring leg/abutment leg designs. This can enable the contact chambers for the current bridge and for the single contacts to be configured in an essentially identical fashion.

In one embodiment, each contact chamber may have catch recesses both for single contacts and for a current bridge. These catch recesses can be arranged in a very wide variety of ways, as long as the catch recesses are able to cooperate with corresponding features, such as catch projections, of the single contacts and/or current bridges.

A catch recess may be provided within each contact chamber to fix the current bridge. Embodiments may also have a catch recess for the current bridge interposed between the two catch recesses for the single contacts, on an inner face of the outer wall of the housing. Catch recesses for the current bridge can each be positioned within the region of the dividing walls that demarcate the corresponding contact chambers from one another.

Other suitable arrangements for holding the single contacts and/or current bridges may be employed, as the present invention is not limited in this respect.

Turn now to the drawings, which for the sake of clarity do not include depictions of single contacts or the arrangement of single contacts within the elongated box-shaped housing 1 of the fuse holder. Also for clarity, the drawings do not show flat fuses that can be inserted into the fuse holder. However, arrow P in FIGS. 2, 3 and 4 indicates the side of the housing from which the flat fuses are inserted into the elongated box-shaped housing. The upper side 2 of the housing 1 is located at the bottom on the plane of projection of FIGS. 2, 3 and 4 respectively.

In the illustrated fuse holder embodiment, slots that are accessible from the upper side 2 are each provided within an elongated box-shaped housing 1. The slots comprise contact chambers 3 arranged side by side in pairs, as is shown for example, in FIG. 1.

The illustrated contact chambers 3 each has an insert opening 4 accessible from the upper side 2. The insert opening can receive the flat feet of the flat fuses. The insert openings 4, when viewed in the direction of insertion, are each adjoined by one receiving shaft 5. The receiving shaft can receive contact feet 6 of a current bridge S, which may be arranged in pairs. The flat feet of the flat fuses can each be inserted into the contact feet of the current bridge. As shown FIG. 1, in one embodiment, the configuration of the contact chambers 3, including the receiving shafts 5 and the insert openings 4, is substantially identical for both the current bridges or the single chambers.

In one embodiment, the fuse holder may cooperate with a current bridge described in commonly assigned U.S. patent application Ser. No. 11/268,676 filed on Nov. 7, 2005 and hereby incorporated herein in its entirety. Other suitable current bridges may be employed as the present invention is not limited in this regard.

In the illustrated embodiment, the receiving shaft 5 of each contact chamber 3 is configured to accommodate two contact feet that are aligned parallel to one another and transverse to the extension direction of the elongated housing 1.

Figure 2:
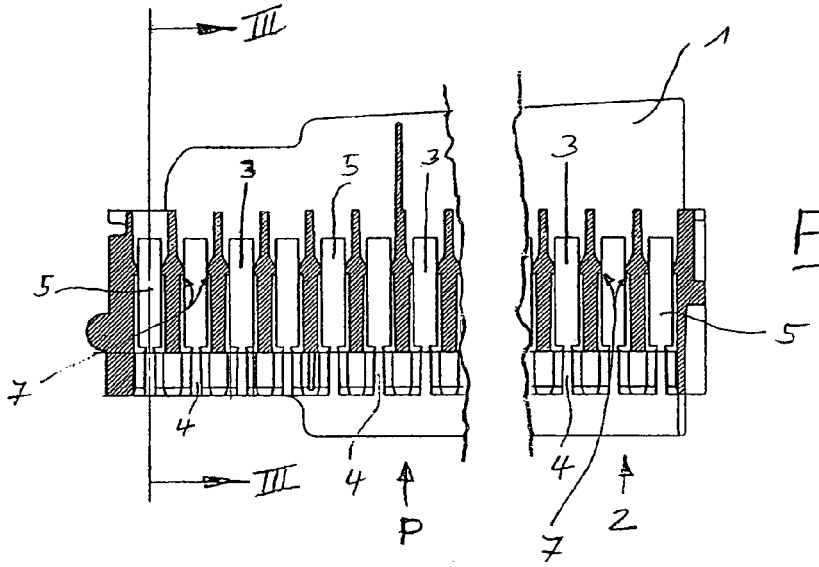
FIG. 2 is a sectional view of the embodiment of FIG. 1 taken along plane II-II of FIG. 1.
Figure 3:
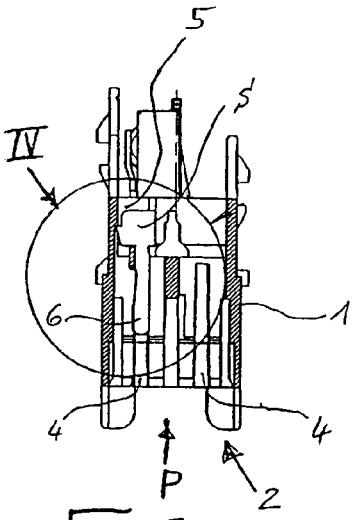
FIG. 3 is a sectional view taken along plane III-III of FIG. 2.
Figure 4:
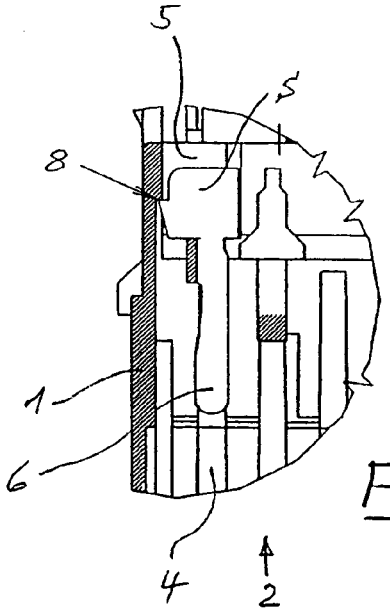
FIG. 4 is an enlarged view of the area encircled by line IV of FIG. 3.
Figure 5:
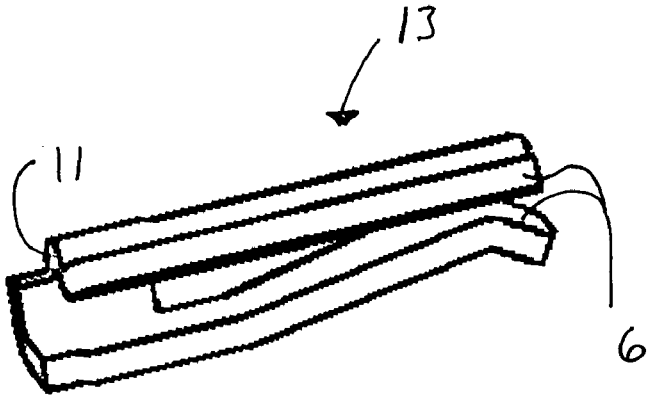
FIG. 5 is a perspective view of a single contact that may be received by embodiments of the fuse holder.
Figure 6:
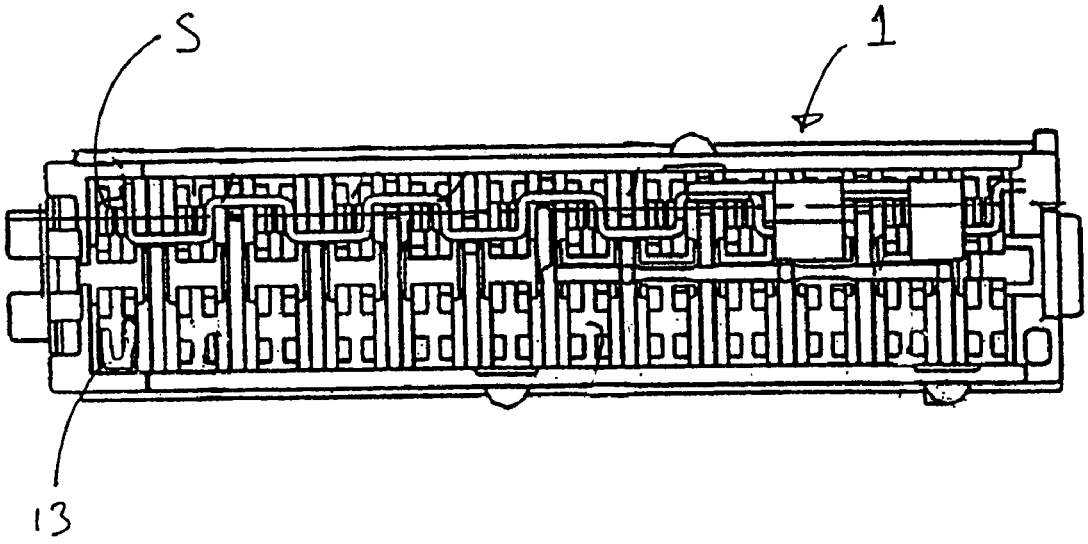
FIG. 6 is a perspective view of a fuse holder, according to one embodiment, showing a single contact and a current bridge in an installed position.

In one embodiment, catch recesses for both single contacts and/or for current bridges can be positioned within the contact chambers. In the illustrated embodiment, each contact chamber has two mutually facing catch recesses 7 (FIG. 2) for corresponding catch projections 11 of single contacts 13 and at least one catch recess 8 (FIGS. 3 and 4) for the current bridge S. Also, in the illustrated embodiment, the catch recesses 7 and 8 are each positioned in the region of the inner face of the contact chambers, as can be seen in FIGS. 2 to 4. The catch recesses 7 for the single contacts, as shown in FIG. 2, each face one another. In this manner, two catch recesses are provided per contact chamber for each single contact, thus helping to ensure that the single contact is securely held within the respective receiving shaft 5 of the contact chamber 3. Since the current bridge S exhibits a certain inherent stability compared to a single contact, because of the meandering form and length of the current bridge across a plurality of contact chambers (as shown in FIG. 1), it may be sufficient to provide a single catch recess 8 for the current bridge in each receiving shaft 5, as is portrayed in FIGS. 3 and 4. In the illustrated embodiment, the catch recess 8 is interposed between the two catch recesses 7 in the region of the outer wall of the elongated box-shaped housing 1.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A fuse holder for use in motor vehicles, the fuse holder comprising:

an elongated box-shaped housing having flat-fuse type slots accessible from an upper side of said housing, the housing having contact chambers arranged below said slots and within said housing and adapted to receive contact feet of single contacts and/or current bridges;

wherein said contact chambers for the current bridge and for the single contacts are substantially identical;

wherein each contact chamber is provided with two mutually facing catch recesses for catch projections of the single contacts, and is also provided with at least one catch recess for the current bridge, and wherein each contact chamber comprises a receiving shaft adapted to receive two contact feet, the feet being aligned parallel to one another and transverse to an extension direction of said elongated housing.

2. The fuse holder according to claim 1, wherein said catch recesses are each arranged in a region of an inner face of the contact chambers.

3. The fuse holder according to claim 2, wherein said catch recess for the current bridge is interposed between said two catch recesses for the single contact on an outer wall of said housing.

4. The fuse holder according to claim 2, wherein said catch recess for the current bridge is positioned on an inner face of an outer wall of the housing and between said two catch recesses for the single contact that are positioned on opposed walls of said contact chambers.

5. The fuse holder according to claim 1, in combination with the current bridge.

6. A fuse holder for use in motor vehicles, the fuse holder comprising:

an elongated box-shaped housing defining a longitudinal axis and having a first side and an opposed second side, the housing comprising:

a plurality of flat-fuse slots disposed in said first side and extending along said longitudinal axis;

a plurality of contact chambers disposed in said second side and extending along said longitudinal axis, each of said contact chambers being substantially identical and being adapted to alternately receive contact feet of a single contact and a current bridge.

7. The fuse holder according to claim 6, wherein each contact chamber comprises:

a pair of opposed catch recesses adapted to retain a single contact; and at least one catch recess adapted to retain a current bridge.

8. The fuse holder according to claim 7, wherein said catch recess for the current bridges are interposed between said two catch recesses for the single contact on an inner portion of an outer wall of said housing.

9. The fuse holder according to claim 7, wherein said catch recess for the current bridge is positioned on an inner face of an outer wall of the housing and between said two catch recesses for the single contact that are positioned on opposed walls of said contact chamber.

10. The fuse holder according to claim 6, wherein each contact chamber comprises a receiving shaft adapted to receive a pair of contact feet that are aligned parallel to one another and transverse to said longitudinal axis.

11. The fuse holder according to claim 6, in combination with the current bridge.

12. A fuse holder for use in motor vehicles, the fuse holder comprising:

an elongated box-shaped housing defining a longitudinal axis and having a first side and an opposed second side, the housing comprising:

a plurality of flat-fuse slots disposed in said first side and extending along said longitudinal axis; and a plurality of contact chambers disposed in said second side and extending along said longitudinal axis, each of said contact chambers being substantially identical and being adapted to receive contact feet of a single contact;

wherein each contact chamber comprises a pair of opposed catch recesses adapted to retain a single contact and at least one catch recess adapted to retain a current bridge.

13. The fuse holder according to claim 12, wherein said catch recess for the current bridges are interposed between said two catch recesses for the single contact on an inner portion of an outer wall of said housing.

14. The fuse holder according to claim 12, wherein said catch recess for the current bridge is positioned on an inner face of an outer wall of the housing and between said two catch recesses for the single contact that are positioned on opposed walls of said contact chamber.

15. The fuse holder according to claim 12, wherein each contact chamber comprises a receiving shaft adapted to receive a pair of contact feet that are aligned parallel to one another and transverse to said longitudinal axis.

16. The fuse holder according to claim 12, in combination with the current bridge.

17. The fuse holder according to claim 12, wherein each of said contact chambers is adapted to alternately receive contact feet of a single contact and a current bridge.

18. A combination of a fuse holder for use in motor vehicles and a current bridge, the combination comprising:

an elongated box-shaped housing defining a longitudinal axis and having a first side and an opposed second side, the housing comprising:

a plurality of flat-fuse slots disposed in said first side and extending along said longitudinal axis;

a plurality of contact chambers disposed in said second side and extending along said longitudinal axis, each of said contact chambers being substantially identical and being adapted to receive either contact feet of a single contact or contact feet of a current bridge; and a current bridge.

19. The fuse holder according to claim 18, wherein each of said contact chambers is adapted to alternately receive contact feet of a single contact and a current bridge.

* * * * *